United States Patent [19]

LaPointe

[11] 4,261,523

[45] Apr. 14, 1981

[54] GRANULATOR

[75] Inventor: Gabriel M. LaPointe, Hopedale, Mass.

[73] Assignee: Wanskuck Company, Providence, R.I.

[21] Appl. No.: 63,000

[22] Filed: Aug. 2, 1979

Related U.S. Application Data

[63] Continuation-in-part of Ser. No. 894,022, Apr. 6, 1978, abandoned.

[51] Int. Cl.[3] ..... B02C 18/16

[52] U.S. Cl. ..... 241/224; 241/285 A

[58] Field of Search ..... 241/285 R, 285 A, 221, 241/222, 224, 242, 73, 160

[56] References Cited

U.S. PATENT DOCUMENTS

| | | | |
|---|---|---|---|
| 413,024 | 10/1889 | Carter et al. | 241/277 |
| 946,752 | 1/1910 | Bahr | 241/28 |
| 1,001,599 | 8/1911 | Willis et al. | 241/277 |
| 1,056,461 | 3/1913 | Simonds | 241/277 |
| 1,699,157 | 1/1929 | Pendleton | 241/277 |
| 2,593,657 | 4/1952 | Coon et al. | 241/222 X |
| 2,873,923 | 2/1959 | Bergman | 241/222 |
| 3,360,207 | 12/1967 | Shelton, Jr. | 241/285 A |
| 3,756,519 | 9/1973 | Reynolds et al. | 241/285 B X |
| 3,779,123 | 12/1973 | Chafee | 241/222 |
| 3,897,016 | 7/1975 | Shah | 241/224 X |
| 3,901,349 | 8/1975 | DeNoyer | 241/285 R X |
| 3,974,970 | 8/1976 | Bertrand et al. | 241/222 |
| 4,000,670 | 1/1977 | Fleetwood | 241/222 |
| 4,000,860 | 1/1977 | Gotham | 241/222 X |
| 4,061,282 | 12/1977 | Walker et al. | 241/222 |

*Primary Examiner*—Mark Rosenbaum

*Attorney, Agent, or Firm*—Norman S. Blodgett; Gerry A. Blodgett

[57] ABSTRACT

Granulator having a rotary cutter and bed knife with V-shaped conjugate cutting edges, movable hopper, and sound-absorbing panels.

8 Claims, 46 Drawing Figures

DETAIL I (FROM FIG.3)

DETAIL 2 (FROM FIG.3)

DETAIL 3 (FROM FIG.5)

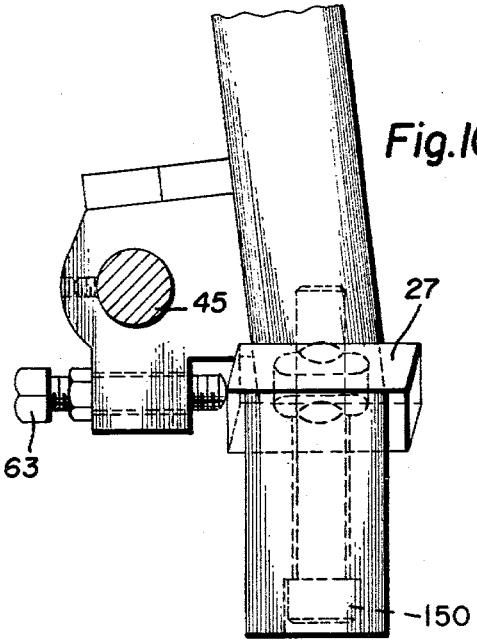
DETAIL 4
(FROM FIG.5)
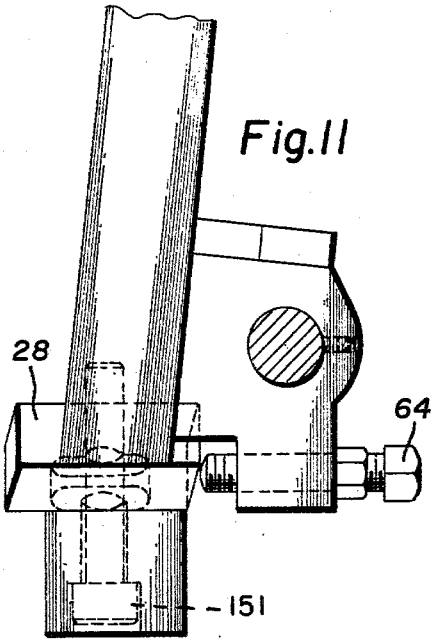
DETAIL 5
(FROM FIG.5)
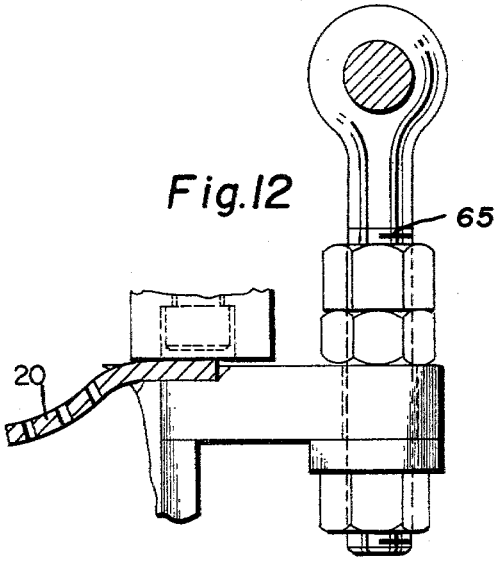
DETAIL 6
(FROM FIG.5)
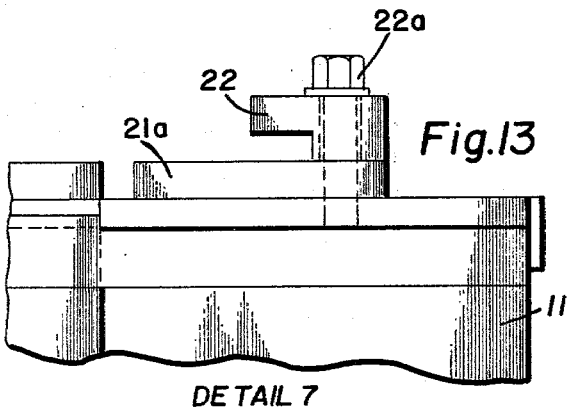
DETAIL 7
(FROM FIG.3)

DETAIL 11
(FROM FIG.22)

DETAIL 12
(FROM FIG.22)

DETAIL 14 (FROM FIG.20)

DETAIL 13
(FROM FIG.20)

DETAIL 15
(FROM FIG.21)

GRANULATOR

RELATIONSHIP TO CO-PENDING APPLICATIONS

This application is a continuation-in-part of patent application Ser. No. 894,022 filed Apr. 6, 1978, now abandoned.

BACKGROUND OF THE INVENTION

There are many instances in industrial activity in which it is desirable to have a machine for comminuting odd-shaped pieces of rather tough material. An outstanding example of this need is in the plastic industry where a considerable amount of scrap is generated; this scrap exists in various forms and consists of somewhat resilient polymers. Such unruly scrap materials are difficult to cut into small pieces, because the shearing blades are subjected to extreme variations of stress due to the odd nature of the materials approaching the blades. The odd shapes are a contributing factor to clogging of the comminuting equipment not only in the feed hopper, but also in the area of the shearing knives. In the past, when it is necessary to unclog the hopper or the cutting blades, it was necessary to completely disassemble the comminuting machine. This meant that the machine was out of operation and presented problems so far as the flow of work through the plant was concerned. Another problem that has been experienced with the prior art comminuting machines is the matter of noise. The very fact that the cutting action is taking place within a hollow housing, means that the optimum conditions exist for the production of noise and no amount of resilient support is able to reduce this noise, as is possible in other types of machinery. Government agencies have insisted that sound levels be kept below a certain minimum and this is difficult to accomplish in a plant producing injection-molded plastics, for instance, where the only appreciable noise is in the comminuting machine. It would be possible, of course, to isolate the machine in its own separate room, but this presents other difficulties. First of all, because it is difficult to move materials in and out of such an isolation chamber and, secondly, it is desirable to be able to move the comminuting machine within the plant from one area of use to another. These and other difficulties experienced with the prior art devices have been obviated in a novel manner by the present invention.

It is, therefore, an outstanding object of the invention to provide a granulator for effectively comminuting scraps consisting of odd-shaped pieces of a tough plastic.

Another object of this invention is the provision of a granulator having a rotary cutter whose bearings and cutting edges are capable of long life, despite use with tough, disorderly materials.

A further object of the present invention is the provision of a granulator having sound-absorbing means which does not interfere with repair of unclogging of the mechanism.

It is another object of the instant invention to provide a granulator which is mobile and yet does not require an isolating chamber to reduce its noise generation.

A still further object of the invention is the provision of a granulator in which noise generated is maintained at a minimum due to reduced thrust forces on the cutter spindle and readily removable sound-absorbing panels.

It is a further object of the invention to provide a granulator whose hood is readily removable from the comminuting area for access thereto without danger to the operator.

It is still further object of the present invention to provide a granulator whose cutting apparatus is efficient, so that relatively small amounts of horse power are required to drive it.

Another object of the invention is the provision of a granulator which is simple in construction, which is inexpensive to manufacture, and which is capable of a long life of useful service with a minimum of maintenance.

Another object of the invention is the provision of a granulator in which the cutting apparatus is arranged to distribute evenly the material to be comminuted throughout the chamber, so that uneven wear of the blade is prevented.

With these and other objects in view, as will be apparent to those skilled in the art, the invention resides in the combination of parts set forth in the specification and covered by the claims appended hereto.

SUMMARY OF THE INVENTION

In general, the invention consists of a granulator having a lower housing containing a rotary cutter and a fixed bed knife and containing an electric motor drivingly connected to the cutter. An upper bearing is provided, including a loading hopper mounted on the lower housing, removable sound-absorbing panels mounted on the surfaces of the lower housing.

More specifically, the rotary cutter has a V-shaped edge with the apex located midway between the ends and the bed knife is similarly V-shaped for conjugate action with the edge of the cutter. The upper housing is mounted on the lower housing for sliding movement from an operative position in which it overlies the rotary cutter to an inoperative position where the rotary cutter is accessible.

BRIEF DESCRIPTION OF THE DRAWINGS

The character of the invention, however, may be best understood by reference to one of its structural forms, as illustrated by the accompanying drawings, in which:

FIG. 10 is an enlarged detail view of a portion of the lower housing designated Detail 4 in FIG. 5, FIG. 11 is an enlarged view of a portion of the lower housing designated Detail 5 in FIG. 5, FIG. 12 is an enlarged view of a portion of the lower housing designated Detail 6 in FIG. 5, FIG. 13 is an enlarged view of a portion of the lower housing designated Detail 7 in FIG. 3.

DESCRIPTION OF THE PREFERRED EMBODIMENT

Figure 1:
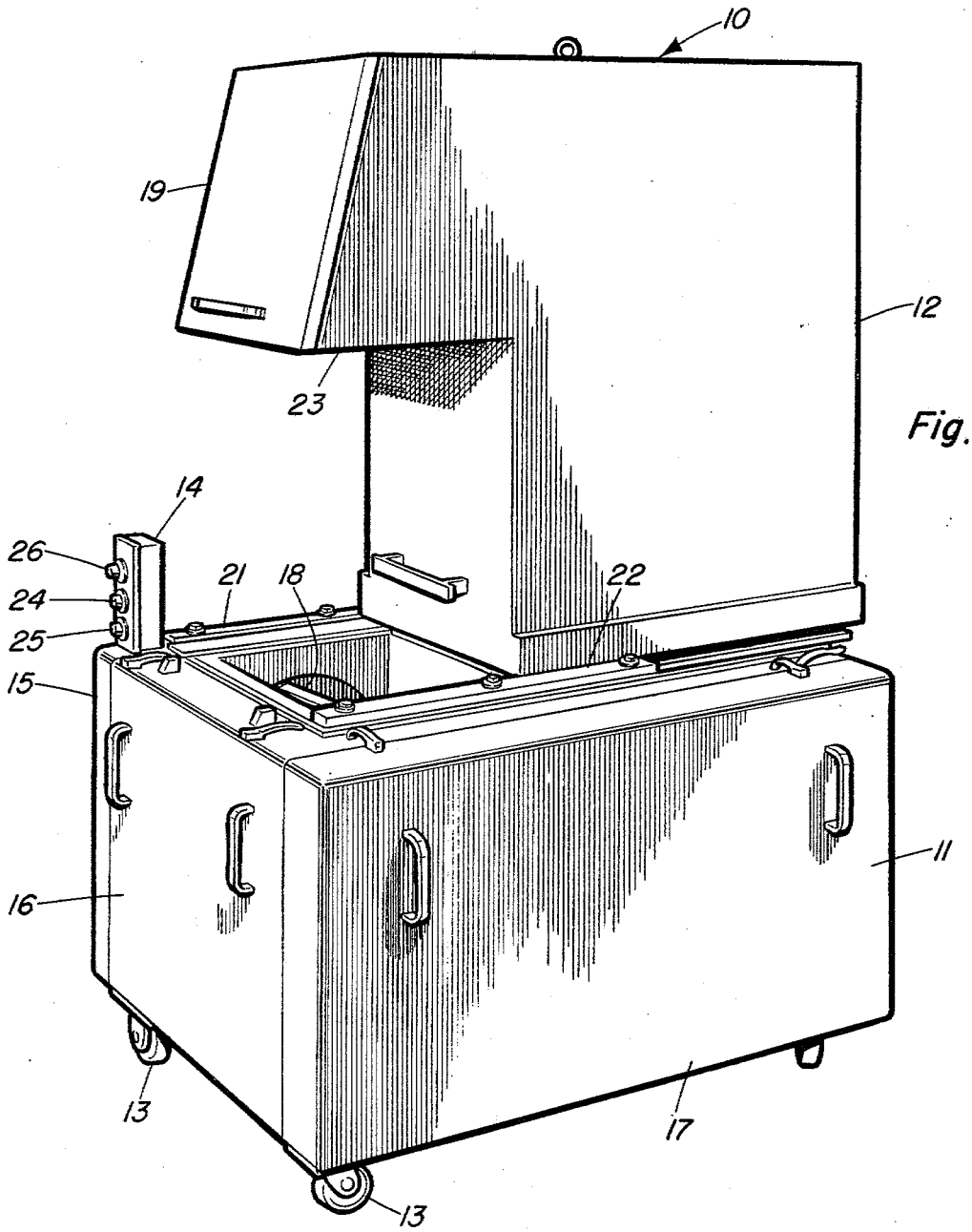
FIG. 1 is a perspective view of a granulator embodying the principles of the present invention.

Referring first to FIG. 1, wherein are best shown the general features of the invention, the granulator, designated generally by the reference numeral 10, is shown as having a lower housing 11 carried on wheels 13. Mounted on the lower housing is an upper housing 12 slidable on occasion in spaced, parallel guides 21 and 22 which are located on an upper horizontal surface of the lower housing. The upper housing 12 has an internal hopper and has a forwardly-directed portion with a hinged loading door 19. Extending upwardly from the front of the lower housing is a central box 14 having an "ON" switch 24, and "OFF" switch 25, and a red warning light 26. The upper housing 12 is shown in the drawing as located at the rear of the lower housing in its "inoperative" position. In this condition a rotary cutter 18 in the interior of the lower housing 11 is exposed. When slid to the front of the lower housing, the upper housing is in its "operative" position overlying the cutter 18. Removable sound-absorbing panels 15, 16, and 17 are mounted on the left side, front, and right side surfaces, respectively, of the lower housing.

Figure 2:
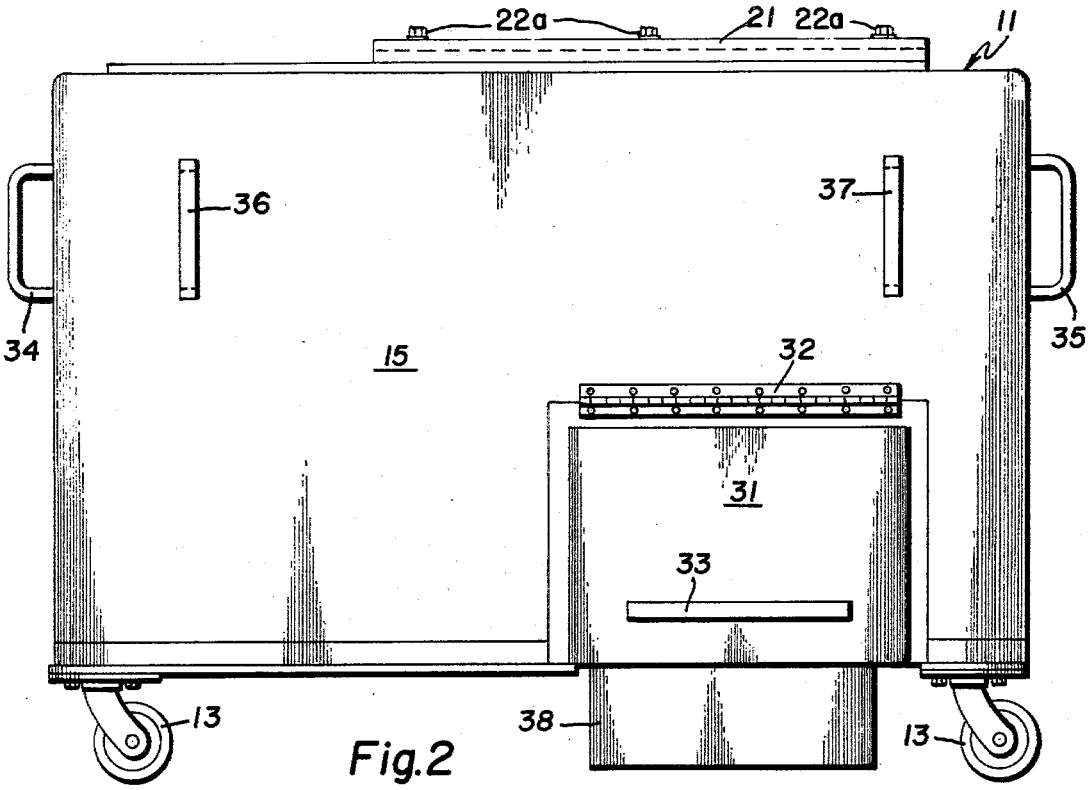
FIG. 2 is a side elevational view of a lower housing of the granulator.

FIGS. 2, 3, 4, and 5 show the general features of the lower housing 11, including fixed bed knives 27 and 28 that are mounted in operative relationship to the rotary cutter 18. A rear sound-absorbing panel 29 is particularly well shown in FIGS. 4 and 5. FIG. 2 shows a hinged door 31 in the left-hand side panel 15 with its hinge 32 and its handle 33. Also evident in this figure are the handles 34 and 35 of the panels 29 and 16, respectively. The left-hand side panel 15 is provided with handles 36 and 37. A receptacle 38 is shown behind the door 31.

Figure 3:
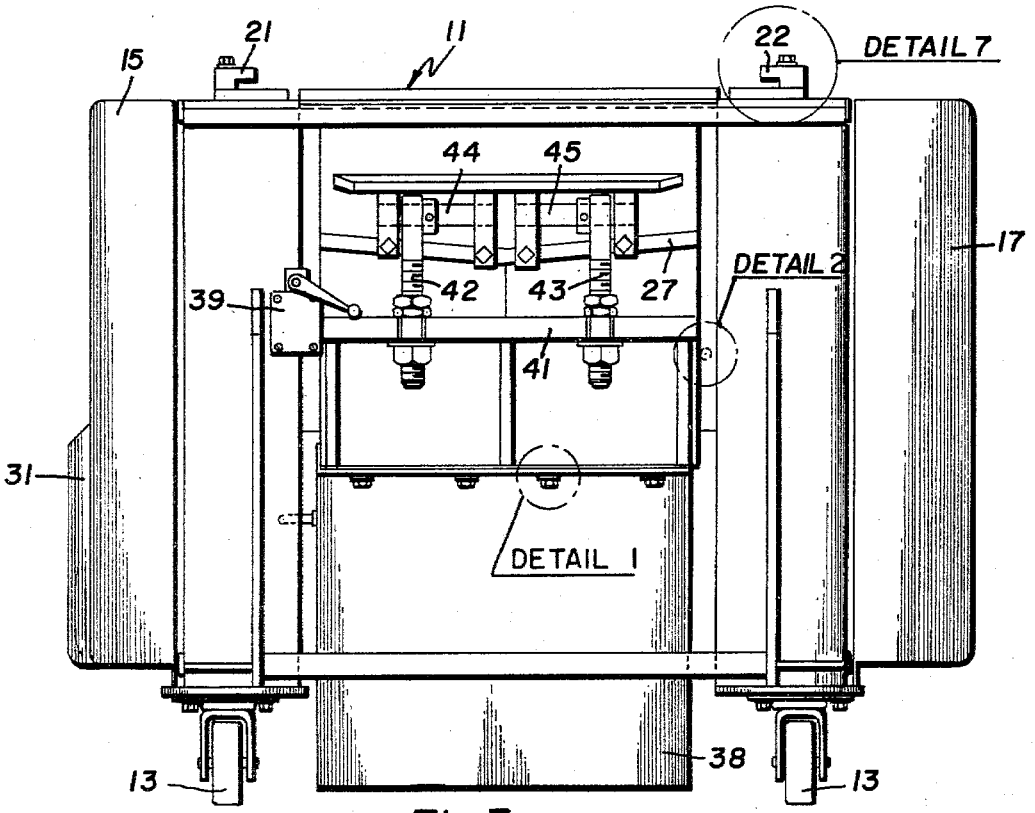
FIG. 3 is a front elevational view of the lower housing.

FIG. 3 shows the front of the machine with the front panel 16 removed to expose the mounting and adjusting means for the knife 27. Located on the frame adjacent the knife support is a limit switch 39. The flange 41 carried two bolts 42 and 43 having suitable nuts above and below the flange 41. The shafts 44 and 45 carried in the upper part of the bolts 42 and 43, respectively, serve to support the knife 27.

Figure 4:
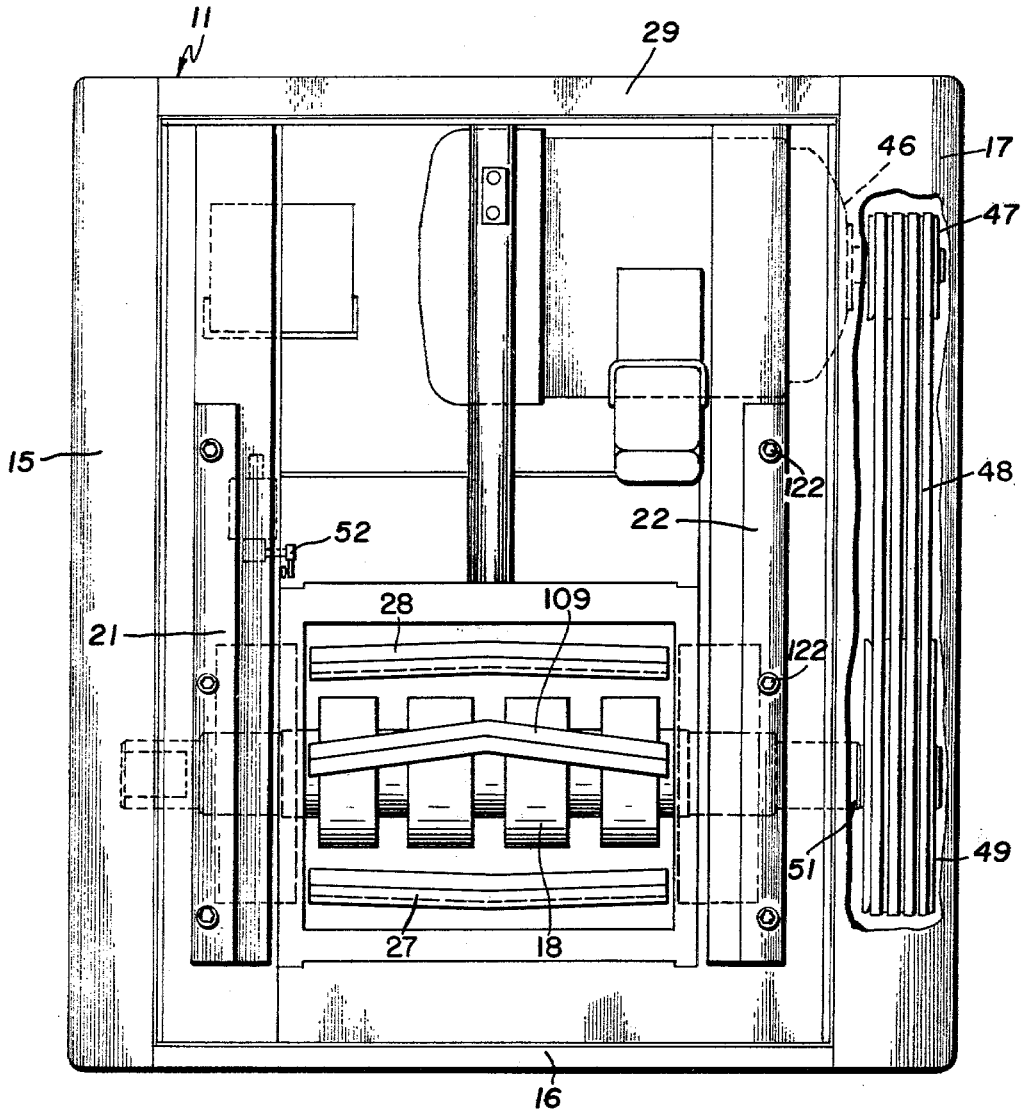
FIG. 4 is a plan view of the lower housing.

As is shown in FIG. 4, an electric motor 46 is mounted at the back portion of the lower housing and its output shaft carried a pulley 47 which is connected by V-belts 48 to a pulley 49 of considerably larger diameter which is mounted on a spindle 51, forming part of the rotary cutter 81. A limit switch 52 is mounted on the lower housing adjacent the guide bar 21 to indicate the position of the upper housing along the guides 21 and 22.

Figure 5:
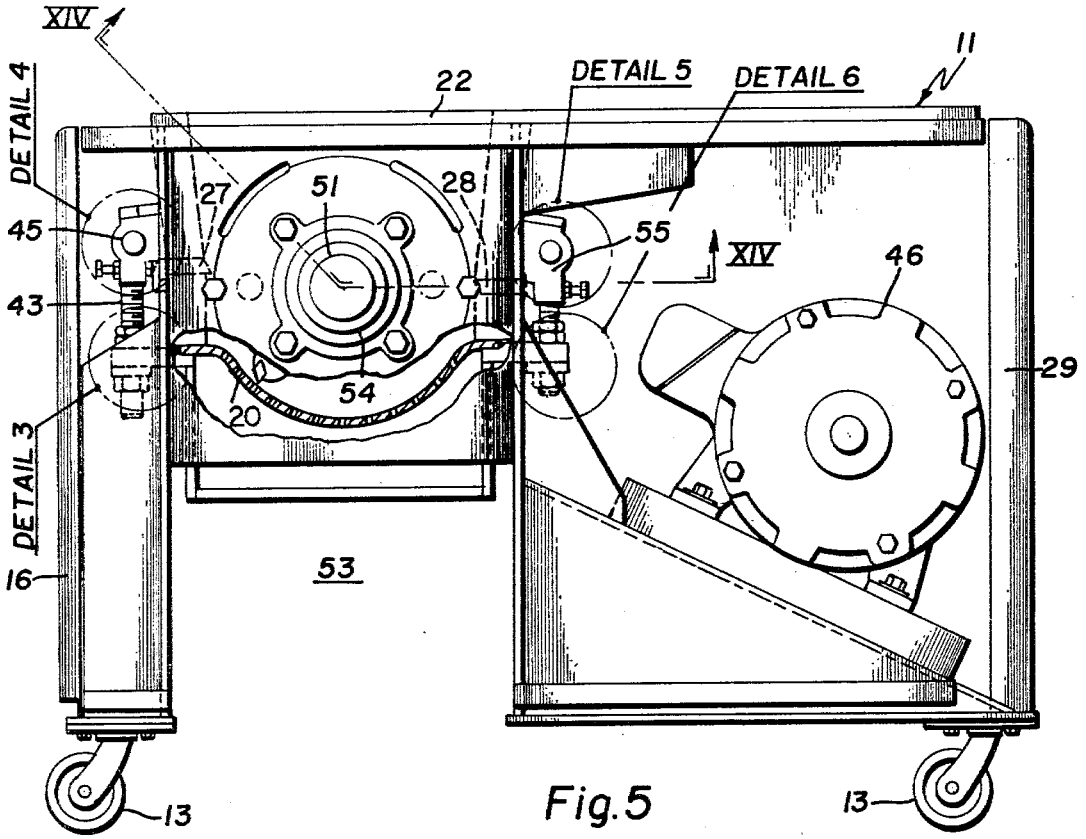
FIG. 5 is a right-hand side elevational view of the lower portion.
Figure 38:
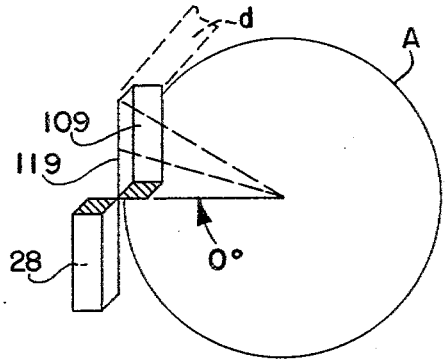
Figure 39:
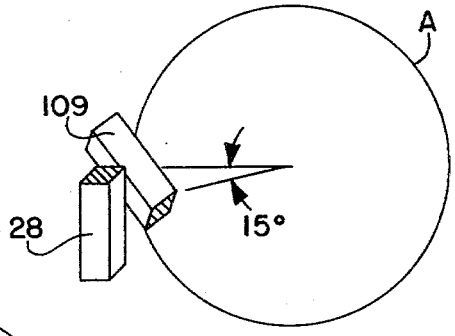
Figure 40:
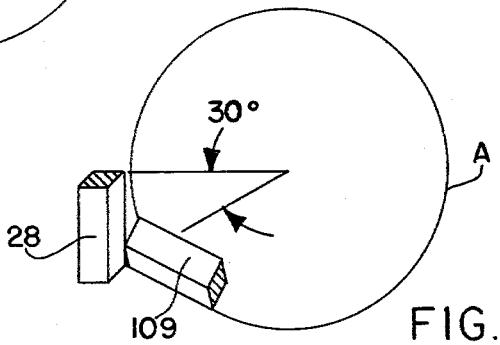

FIG. 5 shows particularly well the manner in which the lower housing 11 is provided with a transverse passageway 53 adjacent the front end and extending completely transversely through the lower housing. A bearing 54 is mounted on the housing to support the spindle 51 and an adjusting apparatus 55 is shown for adjusting the bed knife 28. The manner in which the electric motor 46 is mounted on an inclined structure is also clearly shown in this figure of the drawings.

Figure 6:
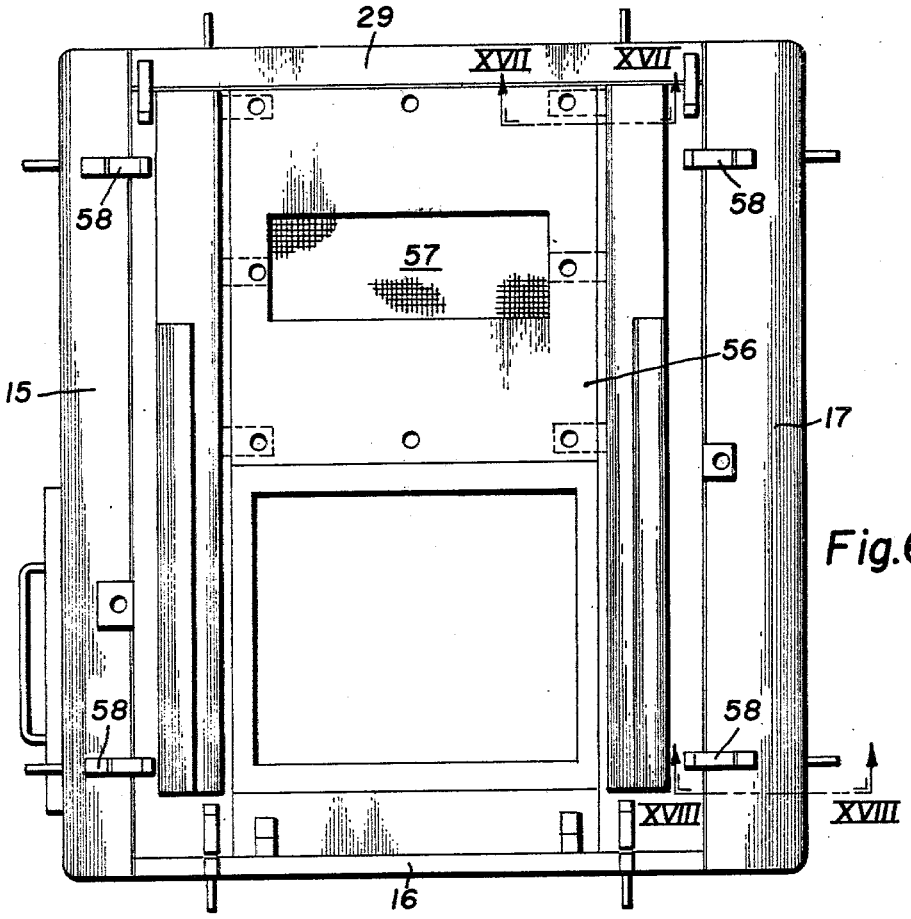
FIG. 6 is another plan view of the lower housing with all sound-absorbing panels in place.

In FIG. 6 it can be seen that the compartment which contains the electric motor is provided with a cover plate 56 having a venting opening covered by a screen 57. It shows the manner in which the side panel 15 is provided with fastening clips 58.

Figure 7:
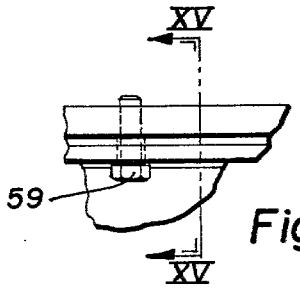
FIG. 7 is an enlarged elevational view of a portion of the lower housing denominated Detail 1 in FIG. 3.
Figure 8:
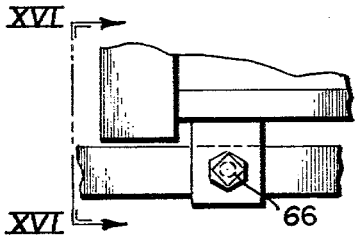
FIG. 8 is an enlarged elevational view of a portion of the lower housing denominated Detail 2 in FIG. 3.
Figure 9:
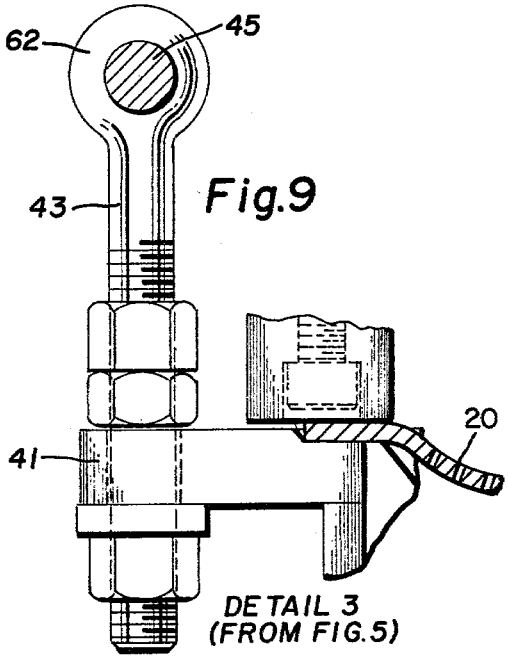
FIG. 9 is an enlarged view of a portion of the lower housing designated Detail 3 in FIG. 5.

FIG. 7, which shows Detail 1 taken from FIG. 3, shows the manner in which screen 20 is mounted on the lower housing by bolt 59. FIG. 8, which is Detail 2 taken from FIG. 3, shows a detail of construction of the lower housing, including centering means for the screen support. FIG. 9, which is Detail 3 taken from FIG. 5, shows the supporting means for the screen 20. It shows the manner in which the bolt 43 is provided with a large bored head 62 which carries the shaft 45. Similarly, FIG. 10 shows Detail 4 from FIG. 5 and adds further details of the knife supporting and adjusting mechanism, including set screws 63 which adjust the knife 27. FIG. 11 which shows Detail 5 from FIG. 5, shows the similar adjusting mechanism, including a set screw 64 which adjusts the other bed knife 28. FIG. 12 is Detail 6 from FIG. 5 and shows one of the eye-bolts 65 mounted on the lower frame and serving to adjust the screen support and the screen 20. FIG. 13 is Detail 7 from FIG. 3 and shows the manner in which the guide 22 is mounted on the lower housing.

Figure 14:
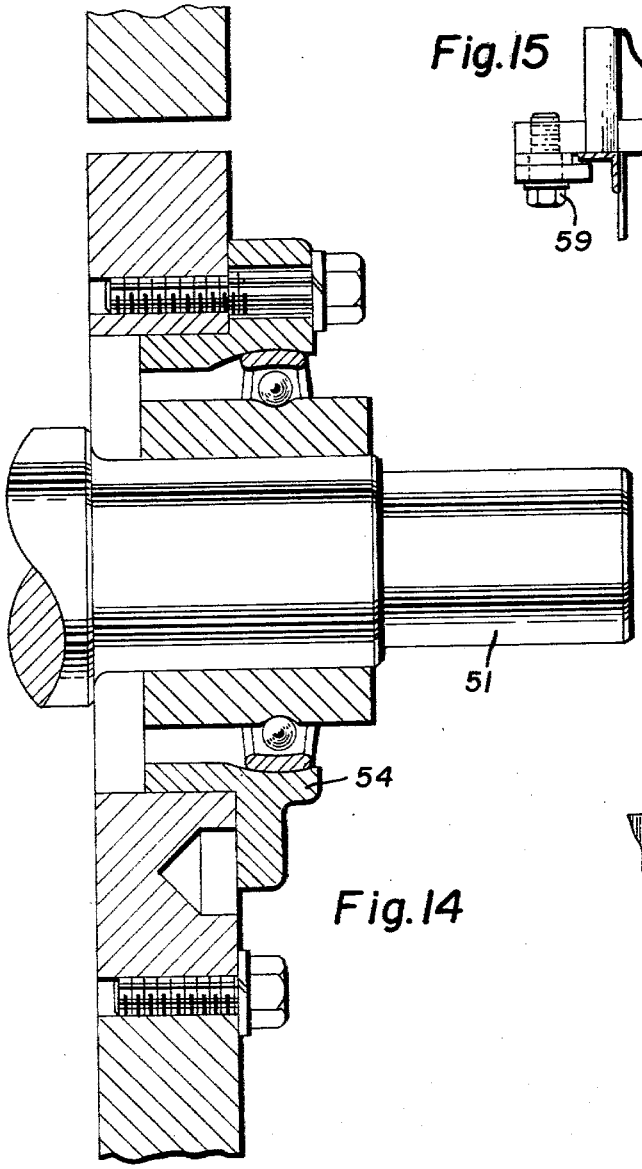
FIG. 14 is a sectional view of a portion of the lower housing taken along the line XIV—XIV in FIG. 5.
Figure 15:
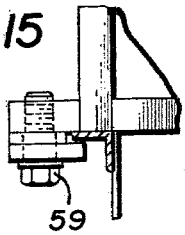
FIG. 15 is a sectional view of a portion of the lower housing taken on the line XV—XV of FIG. 7.
Figure 16:
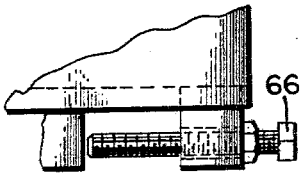
FIG. 16 is a sectional view of a portion of the lower housing taken on the line XVI—XVI of FIG. 8.
Figure 17:
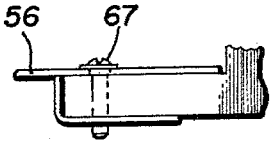
FIG. 17 is a sectional view of a portion of the lower housing taken on the line XVII—XVII of FIG. 6.
Figure 18:
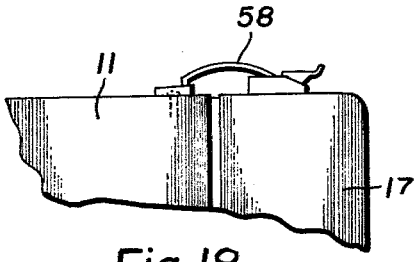
FIG. 18 is a sectional view of a portion of the lower housing taken on the line XVIII—XVIII of FIG. 6.

FIG. 14 is a sectional view taken on the line XIV—XIV of FIG. 5 and shows the details of the bearing 54 in which is supported one end of the spindle 51. The bearing is shown as being of the ball-bearing type with very little provision for receiving thrust loads, since it is not necessary in the present invention. FIG. 15 shows details of a sectional view of the invention taken on the line XV—XV of FIG. 7, showing the relationship of the bolt 59 with the adjacent structure. FIG. 16 is a detail of the apparatus taken on the line XVI—XVI of FIG. 8 and it shows an adjusting screw 66 which is capable of adjusting the blade longitudinally of the spindle 51. FIG. 16, which is a sectional view taken on the line XVII—XVII of FIG. 6, shows the method of attachment of the plate 56 by means of bolts 67. FIG. 18, which is a sectional view taken on the line XVIII—XVIII of FIG. 6, shows the details of construction of the typical panel-holding clip 58.

Figure 19:
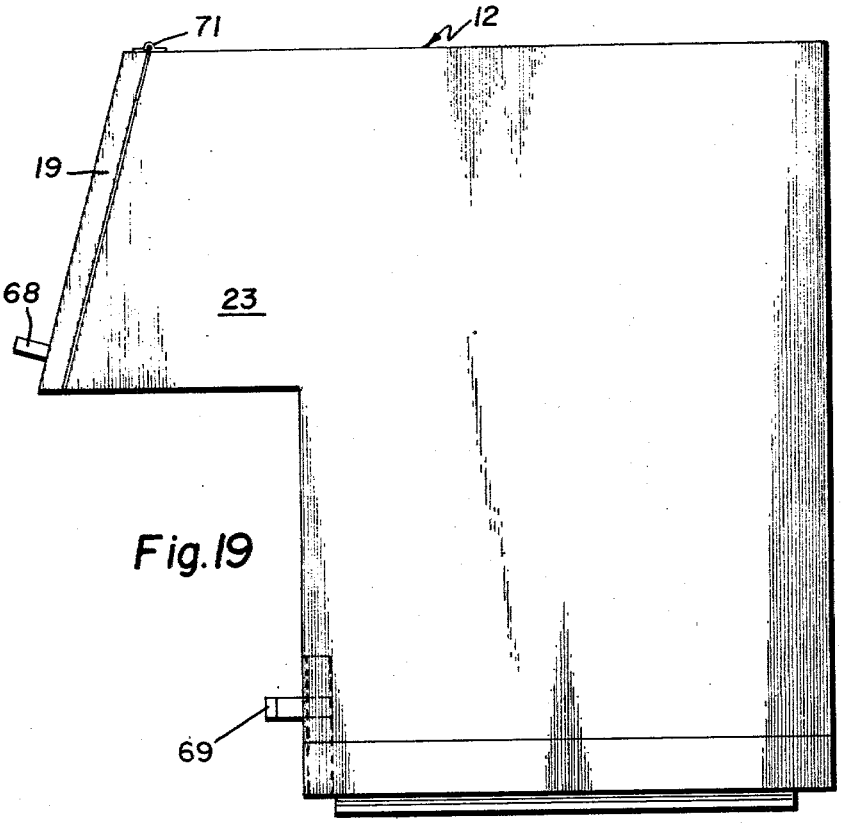
FIG. 19 is a right-hand side elevational view of an upper housing forming part of the granulator.
Figure 20:
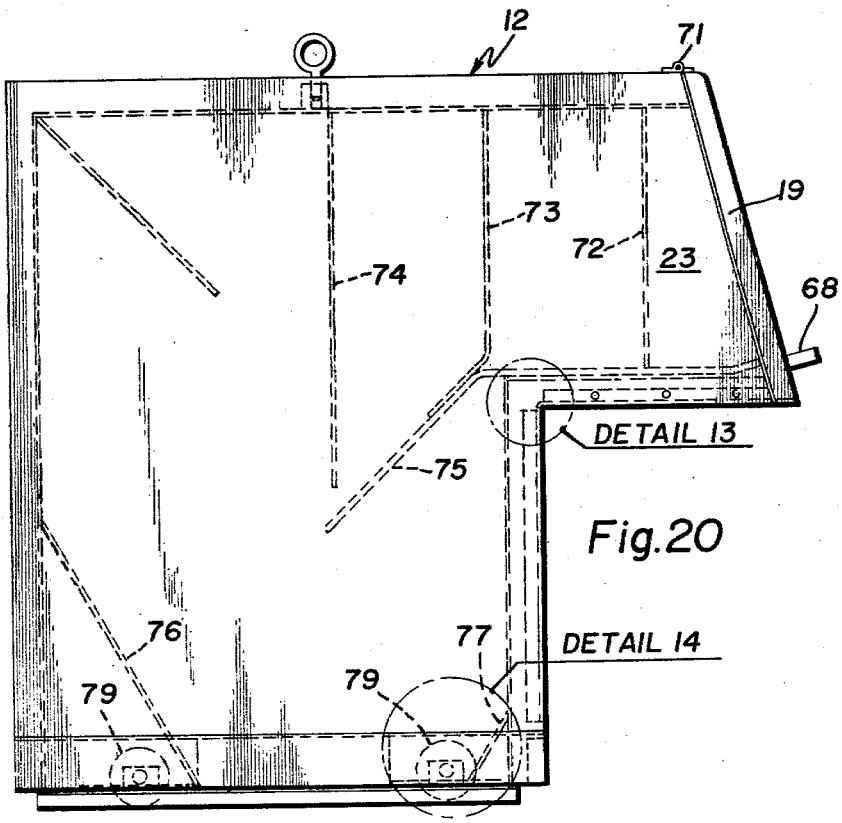
FIG. 20 is a left-hand side elevational view of the upper housing.
Figure 21:
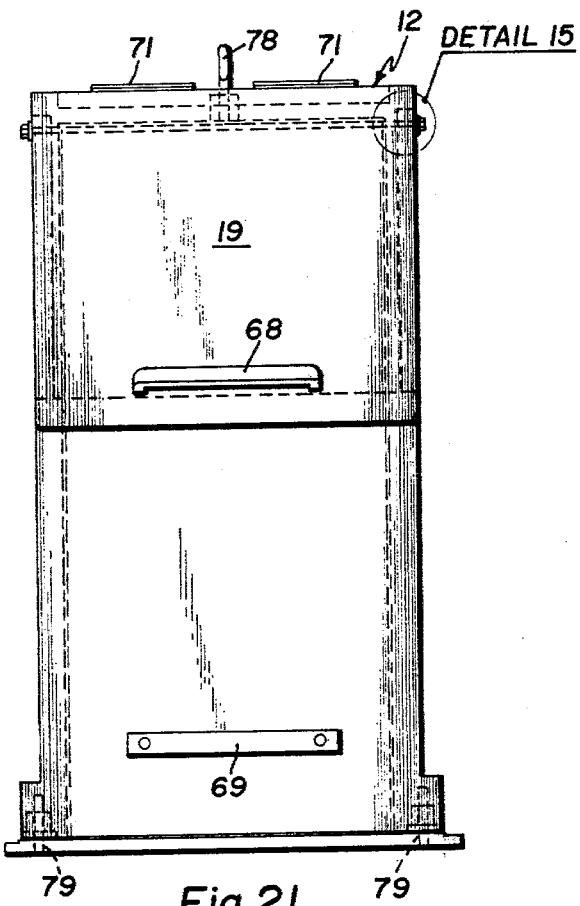
FIG. 21 is a front elevational view of the upper housing.

FIGS. 19, 20, 21, and 22 show the general features of the upper housing 12. FIGS. 19 and 20 show the manner in which the housing is provided with a forwardly-extending portion 23 provided with an inclined door 19. The door is provided at the top with a horizontal hinge 71 and at the bottom with a handle 68. A large handle 69 is located adjacent the lower part of the main part of the housing for pulling the housing forward along the guides 21 and 22 of the lower housing. On its interior the upper housing is provided with three successive swingable curtains 72, 73, and 74 leading to a downwardly and rearwardly inclined wall 75. At its lower portion two inclined walls lead to the grinding portion and combine to form a hopper leading to the grinding portion of the apparatus. Extending from the top of the upper portion is a ring-bolt 78 for hoisting the upper portion when necessary. Located on each side of the upper housing is a wheel assembly 79.

Figure 22:
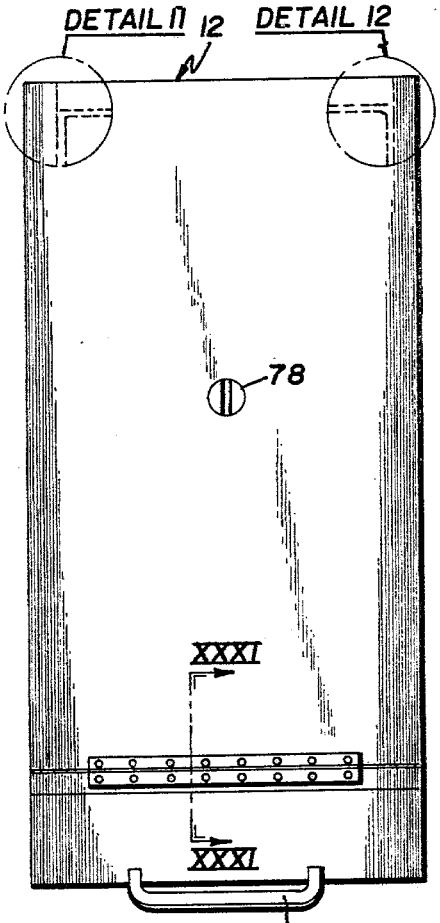
FIG. 22 is a plan view of the upper housing.
Figure 23:
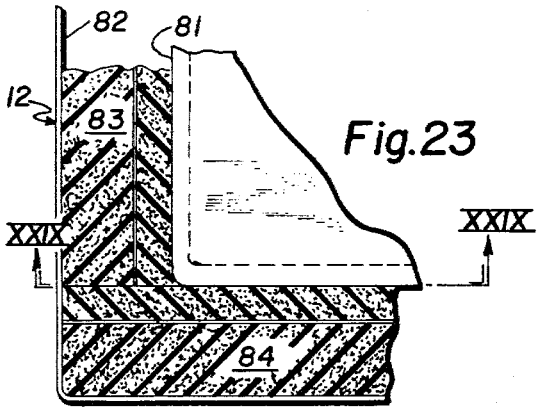
FIG. 23 is a sectional view of the upper housing designated as Detail 11 in FIG. 22.
Figure 24:
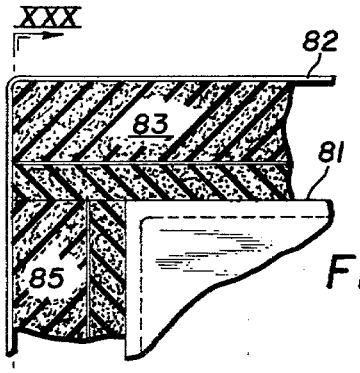
FIG. 24 is a sectional view of a portion of the upper housing designated Detail 12 in FIG. 22.
Figure 25:
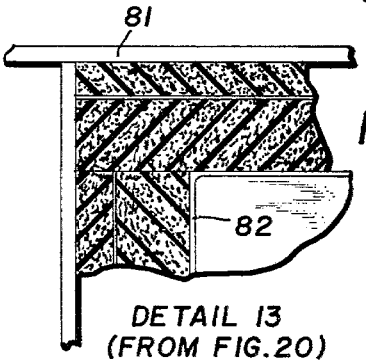
FIG. 25 is a sectional view of a portion of the upper housing designated Detail 13 in FIG. 20.

FIG. 23, which is Detail 11 from FIG. 22, shows the manner in which the upper housing 12 consists of an inner sheet metal container 81, an outer sheet metal container 82 which are held in spaced, parallel relationship by sound-absorbing panels 83 and 84. FIG. 24, which is Detail 12 from FIG. 22, shows the opposite rear corner and the similar construction along with the sound-absorbing side panels 85. FIG. 25, which is Detail 13 from FIG. 20, shows the similar construction on the interior corner between the main portion of the housing and the forwardly-extending portion 23.

Figure 26:
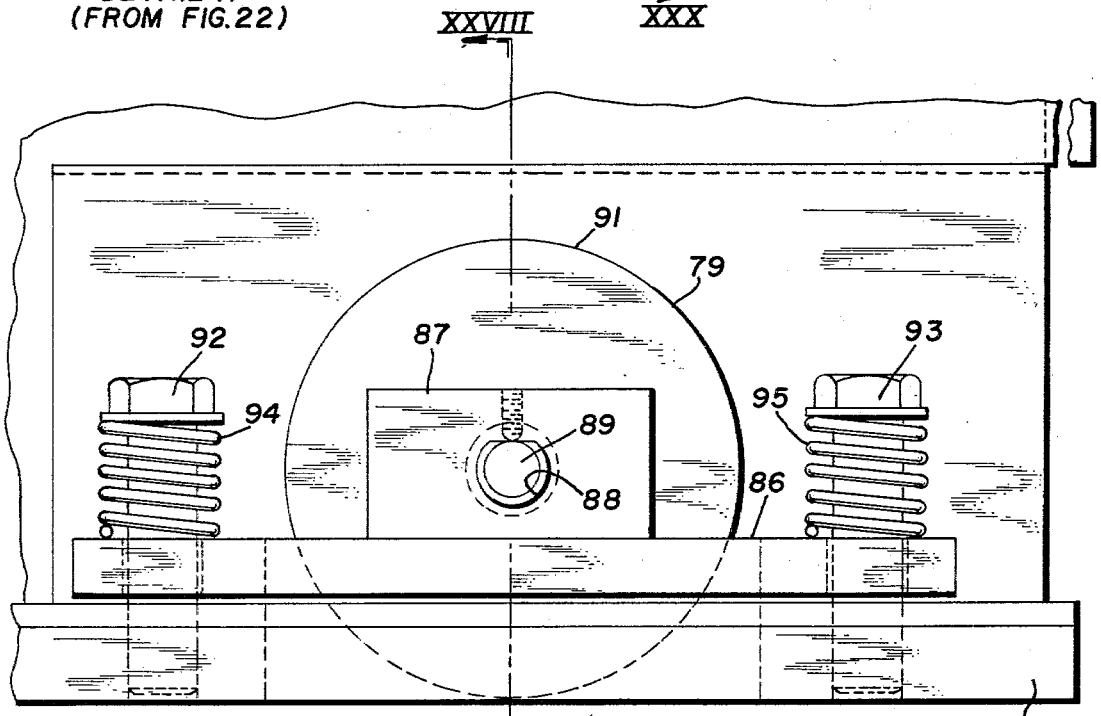
FIG. 26 is an elevational view of a portion of the upper housing designated Detail 14 in FIG. 20.
Figure 27:
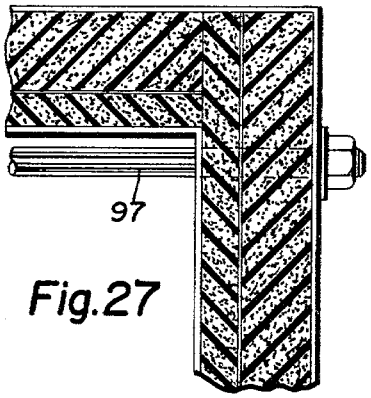
FIG. 27 is a sectional view of a portion of the upper housing designated Detail 15 in FIG. 21.
Figure 28:
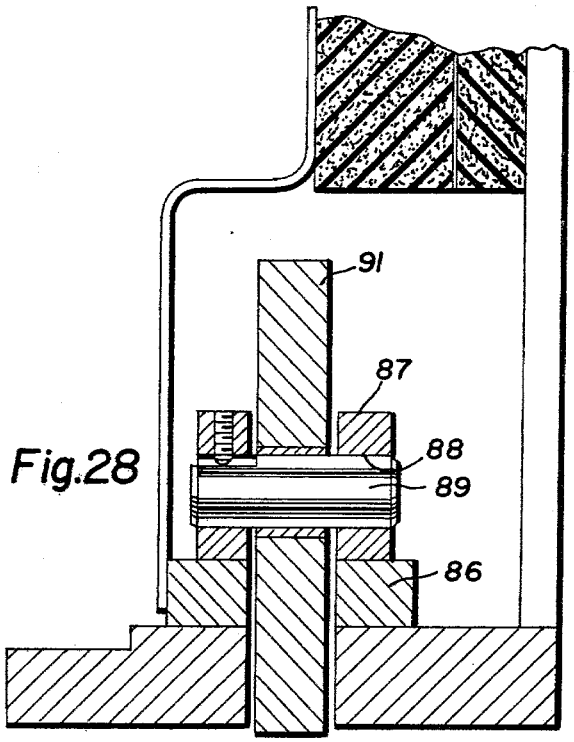
FIG. 28 is a sectional view of a portion of the upper housing taken on the line XXVIII—XXVIII of FIG. 26.
Figure 29:
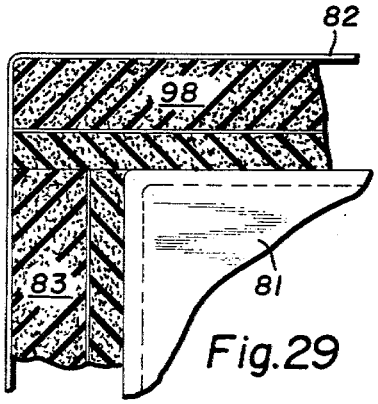
FIG. 29 is a sectional view of a portion of the upper housing taken on the line XXVIV—XXVIV of FIG. 23.
Figure 30:
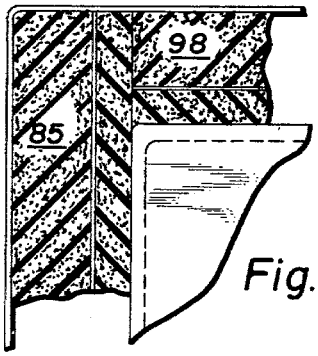
FIG. 30 is a sectional view of a portion of the upper housing taken on the line XXX—XXX of FIG. 24.

FIG. 26 shows the details of the wheel assembly 79 and constitutes Detail 14 from FIG. 20. Mounted between the walls of the upper housing is a horizontal flange 86 with an upper portion carrying a block 87 which has a transverse bore 88 in which is locked a spindle 89 on which is rotatably carried a wheel 91. Extending downwardly through apertures in the opposite ends of the flange 86 are bolts 92 and 93, each biased in the upward direction by a coil spring 94 and 95, respectively. The lower ends of the bolts are threaded into a rail 96 extending along each side of the upper housing and arranged to engage on occasion with the guides 21 and 22 on the lower housing 11. FIG. 27 shows Detail 15 from FIG. 21 which is the detail of the housing and sound-absorbing construction, including an elongated transversed rod 97 which extends across the top of the housing. FIG. 28, which is a vertical sectional view taken on the line XXVIII—XXVIII of FIG. 26, shows further details of the wheel construction. FIG. 29, which is a sectional view taken on the line XXVIV—XXVIV of FIG. 23, and FIG. 30, which is a sectional view taken on the line XXX—XXX of FIG. 24, show further details of the manner in which the housing is constructed with interior and exterior containers and insulating panels, including a top sound-absorbing panel 98.

Figure 31:
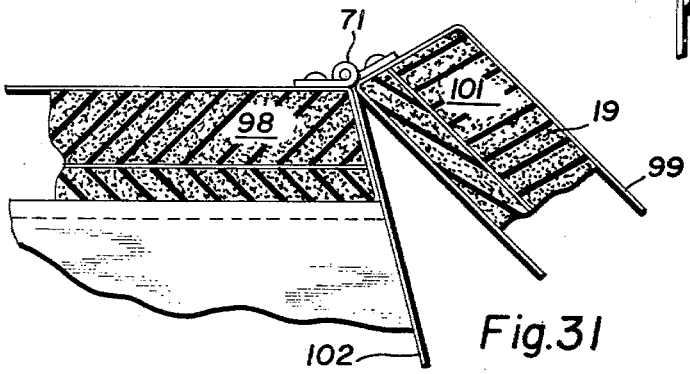
FIG. 31 is a sectional view of a portion of the upper housing taken on the line XXXI—XXXI of FIG. 22.
Figure 32:
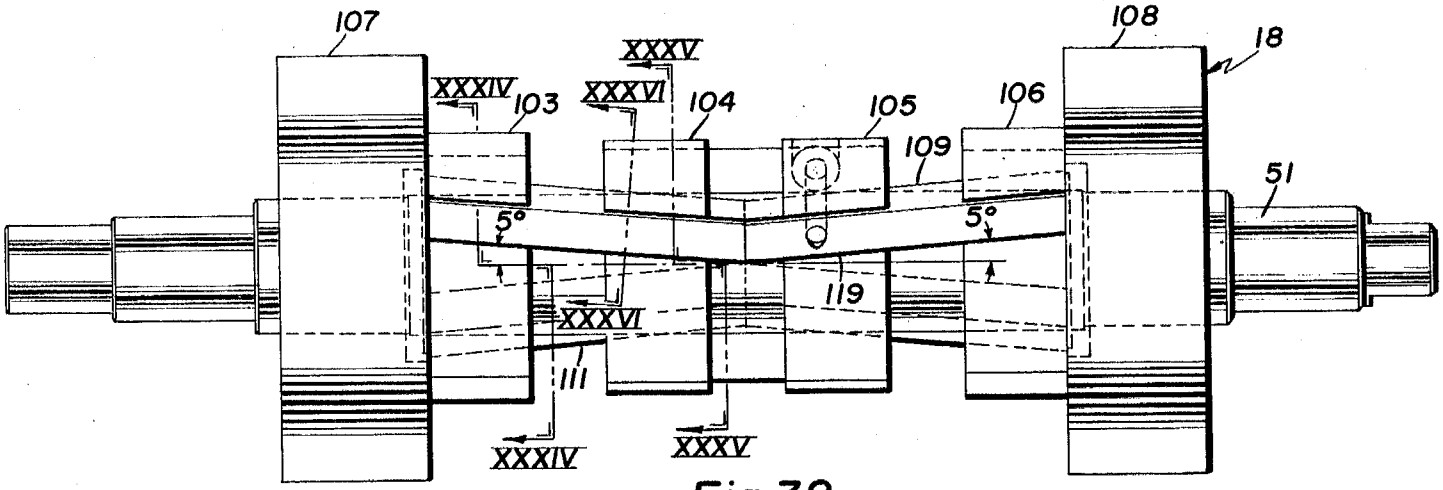
FIG. 32 is an elevational view of a rotary cutter incorporated in the granulator.
Figure 33:
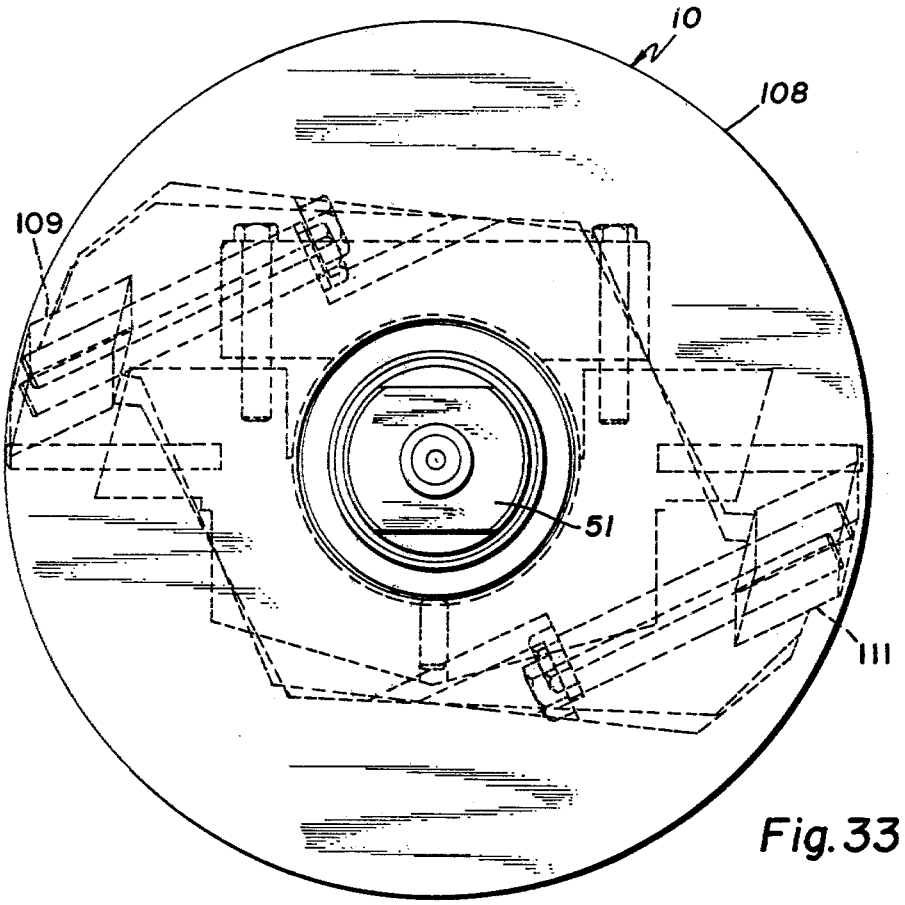
FIG. 33 is an end elevational view of the rotary cutter.
Figure 37:
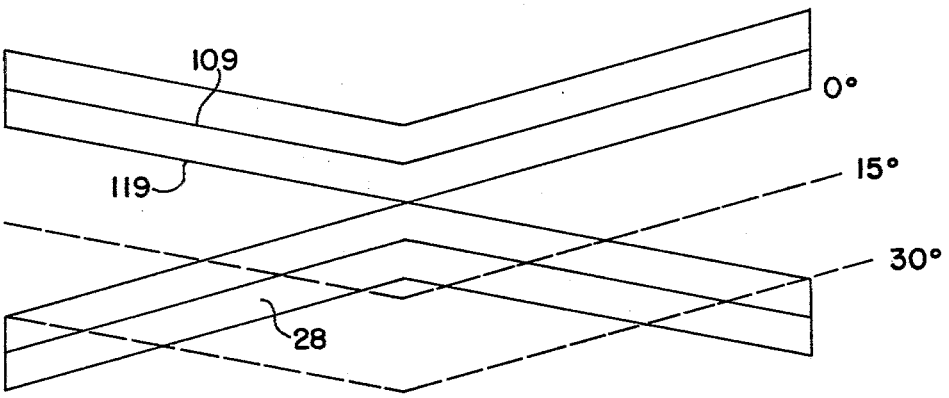

FIG. 31 shows the manner in which the door 19 is provided with an outer casing 99 and an inner sound-absorbing panel 101. The main body of the upper housing around the edge opening defined by the door 19 is provided with a resilient seal 102.

Figure 34:
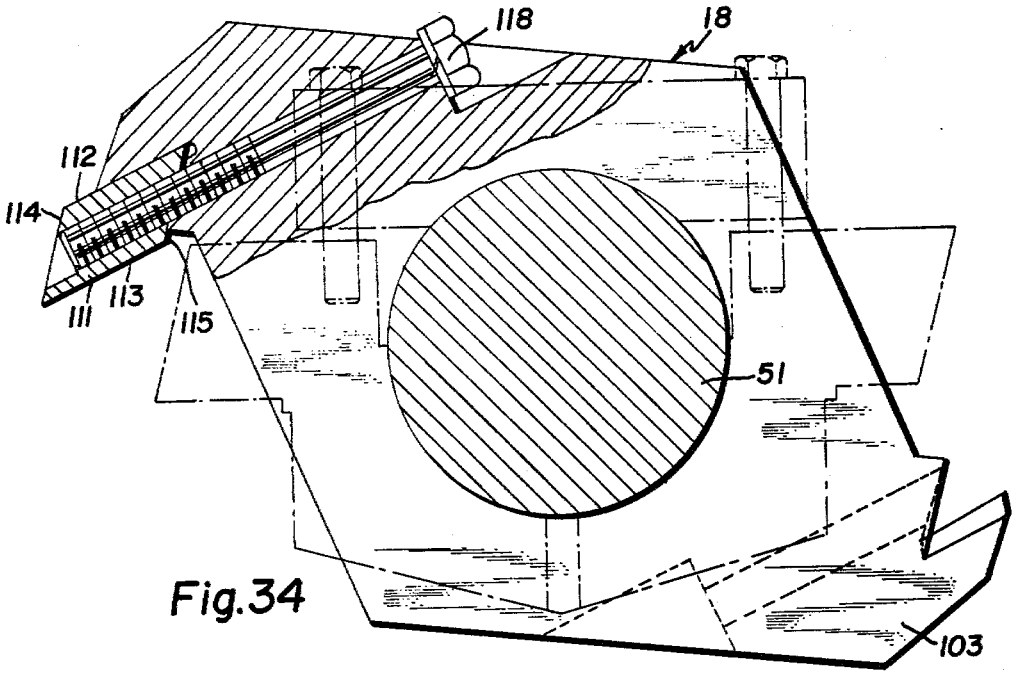
FIG. 34 is a sectional view of the cutter taken on the line XXXIV—XXXIV of FIG. 32.
Figure 35:
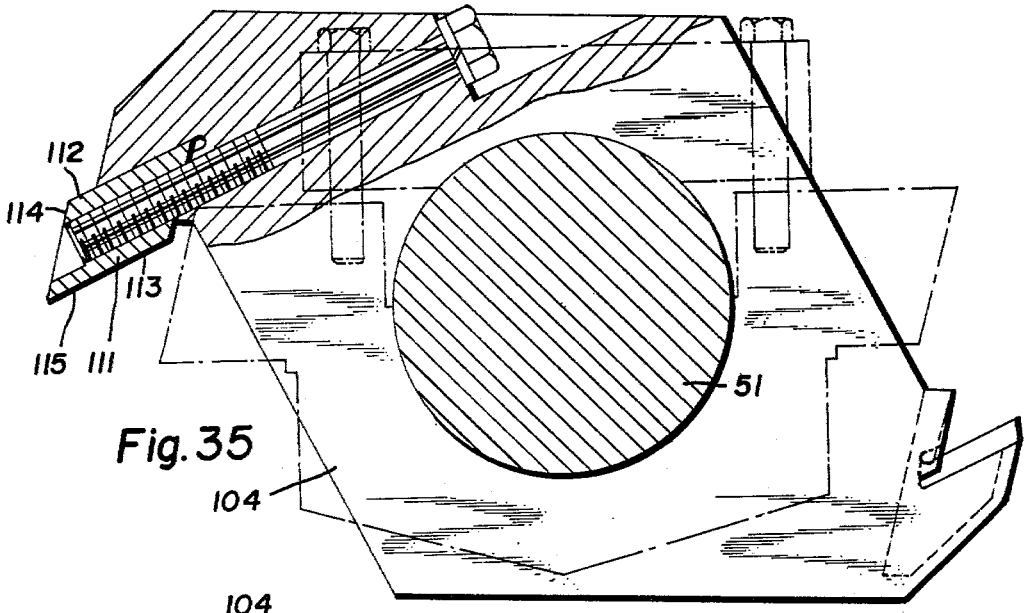
FIG. 35 is a sectional view of the cutter taken on the line XXXV—XXXV of FIG. 32.

FIGS. 32–36 show the details of the rotary cutter 18. It can be seen that the cutter is provided with an elongated spindle 51 whose ends are carried in the bearings 54 (FIG. 5) on which are carried a plurality of mounting blocks 103, 104, 105, and 106. At the ends of the spindle exterior of all of the blocks are large flywheels 107 and 108. Two V-shaped blades 109 and 111 are carried in the mounting blocks and positioned diametrically of the spindle 51. The blade 111, as is clear in FIGS. 34 and 35, is formed with spaced-parallel main surfaces 112 and 113 and edge surfaces 114 and 115 extending angularly therefrom, so that the cross-sectional shape is that of a parallelogram, a knife 109 is similarly formed.

Figure 36:
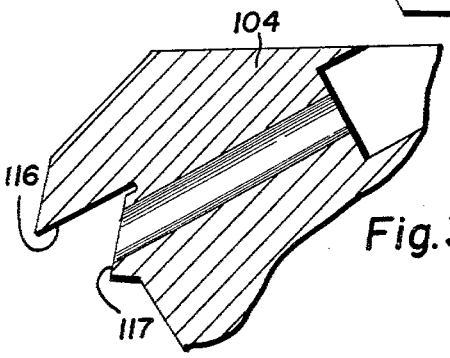
FIG. 36 is a sectional view of the cutter taken on the line XXXVI—XXXVI of FIG. 32, FIGS. 37–40 are schematic views of the blades, illustrating their geometric relationship at various points in their relative movement.

The blocks 103, 104, 105, and 106 are suitably provided with angular recesses to hold the knives. For instance, FIG. 36 shows the portion of the block 104 (indicated by the sectional line XXXVI—XXXVI of FIG. 32) where the recess that carries the blade is defined by the surfaces 116 and 117 which lie in the preferred embodiment at an angle of 50° 30′. As is indicated in FIG. 34, a large bolt 118 extends through a suitable bore in the block 103 and engages in threaded aperture in the knife 111 to draw the knife up into the V-shaped recess, the cutting blade being defined by the intersection of the surfaces 113 and 114. Similar bolts are provided in connection with each of the blocks and to hold each of the knives in place on the block. It can be seen that the knives are reversible in their seats on the block. In reverse condition for instance, the blade 119 will use as it cutting edge the intersection of the surfaces 112 and 115. As is evident in FIG. 32, the cutting edge 119 of the blade 109 is V-shaped with a horizontal dihedral angle of 5°.

Referring to FIG. 13, it can be seen that the guide 22 consists of a plate **21*a* mounted on the upper surface of the lower housing 11, and having an upper horizontal surface on which is mounted the guide 22 which is of L-shaped cross-section and held down by a series of bolts 22*a*. In the preferred embodiment three of these bolts are provided and are best shown in FIGS. 2 and 4. In assembly the rail 96 (FIG. 26) is carried under the overhanging lip of the guide 22. A similar arrangement is provided in connection with the guide 21**.

The operation of the granulator 10 will now be readily understood in view of the above description. With the upper housing 12 in the forward position overlying the rotary cutter 18, the door 19 is lifted upwardly by using the handle 68 for the introduction of the plastic material to be granulated. It falls downwardly through the swingable plates 72, 73, and 74 down the inclined wall 75 and is directed by the inclined walls 76 and 77 into the rotary cutter. As the material falls downwardly, it engages the blades, while the cutter blades 109 and 111 engage the bed blades 27 and 28.

When necessary, the cutter blade 27 can be adjusted by use of the mechanism shown in FIG. 3. The rear blade 28 is similarly adjustable by the same type of mechanism 55 in the manner shown in FIG. 5, access being possible from the chamber containing the electric motor 46. It is necessary to move the upper housing 12 rearwardly, so that it is in the condition shown in FIG. 1 in order that the cutting blades are available. It is only necessary to loosen the bolts 22*a* (FIGS. 2, 4, and 13). Referring to FIG. 26, when the bolts 22*a* are loosened, the rails 96 are free to move upwardly under the impetus of the springs 94 and 95 in each of the wheel assemblies 79. This is because the spring pushes the bar 86 downwardly carrying the wheel 91 into contact with the upper surface of the plate 21*a*. The weight of the upper housing 11 is, therefore, carried on the wheels 91. The operator need only grasp the handle 69 and he can move the upper housing rearwardly until it arrives at the position shown in FIG. 1. As it moves rearwardly, the limit switch 21 is engaged and disconnects all electrical apparatus, so that the electric motor 46 cannot operate and the rotary cutter cannot be revolved. The rotary cutter 18 and the associated bed blades are available for cleaning. If there is a jam, it is possible to remove the jammed plastic material.

When the receptacle 38 is full, it is only necessary to grasp the handle 33 on the door 31 at the left-hand side of the lower housing and rotate it about the hinge 32 to have access to the passage 53 in which the receptacle lies. It can be withdrawn, emptied, and an empty receptacle restored to that position to receive the comminuted plastic. Further access to the sides of the lower housing can be obtained by removing the sound-absorbing panels 15 or 17 by releasing the clamps 58 (see FIG. 6). In order to adjust the bed knife 27, it is necessary to remove the sound-absorbing panel 16 from the front end by releasing similar clamps. The rear side is also available by removing the rear panel 29.

The apparatus can be moved around within the plant from one station to another, because of the presence of the wheels 13. An electrical connection must be available, of course, at each station. Operation of the electric motor 46 is set in place by use of the "ON" switch 24 and the "OFF" switch 25. The red light 26 indicates when the electric motor is energized. FIGS. 9 and 10 show the manner of adjusting the bed knife 27 by adjusting the Eye-bolt 43 up and down relative to the flange 41 and by use of the set screw 63. FIGS. 11 and 12 show a similar method for adjusting the bed knife 28.

It will be clearly understood that the conventional single slant knife rotor design produces a thrust-force that is exerted in one direction only, which adds thrust loads to the bearing at one end in addition to its usual radial load. Furthermore, material resting on the screen is swept to one end of the chamber and this results in unequal wear on the knives. With the present invention, a thrust force is exerted in both directions parallel to the centerline of the rotor shaft. The thrust force in one direction cancels the thrust force in the opposite direction, resulting in radial loads only on the rotor bearings. This design also makes possible a greater slant angle on the bed and bed knives, since one need not be concerned with the thrust forces, because they balance one another. Furthermore, with the present construction the material resting on the screen is swept to both ends of the chamber and this results in uniform load and wear on the entire length of the knives. Naturally, both the rotor and bed knives are reversible, as has been pointed out, so that sharpening of the knives takes place less often than otherwise.

It can be seen, then, that the present invention provides a granulator of high efficiency, reliability, and quality. By angling the rotor and bed knives as V-shaped to intersect at the cutting chamber centerline, the highest and most effective double-angle has been achieved. All forces are distributed uniformly within the cutting chamber to minimize stress on the rotor and load on the rotor bearings. Bearing life is prolonged and the overall operating efficiency is increased. The knives are of such a form as to be easily resharpened. When the upper housing or hopper clamps bolts are loosened the hopper rises on the spring-loaded roller carriages and can be pushed effortlessly toward the rear to expose the entire cutting chamber at waist level. Since the rotor and bed knives are reversible, the fact that the hopper can be rolled back makes it easier to reverse them. For safety reasons, interlocking disconnects are provided at the danger points. Furthermore, to conform to existing sound level regulations, the entire machine has been sound-insulated. It is so quiet in fact, that a red indicator light 26 has been provided to remind the operator that the unit is running. For routine inspection or maintenance, the side and front and rear sound-insulating panels are unsnapped and the panels removed in seconds. The ground material is collected in a deep tray at the bottom of the unit and is readily introduced and removed.

The relationship between the moving knife 109 and the bed knife 28 during cutting is clearly shown in FIGS. 37–40. The cutting edge 119 of the knife 109 lies in a plane that is longitudinal to an imaginary cylinder A which is concentric to the axis of the spindle 5, of the rotary cutter 18. The cutting edge of the fixed bed knife 28 lies in a vertical plane. As is evident in FIG. 38, when the vertices first engage (0°), the two planes are vertical and are the same plane. Every point on the edge 119, except the vertex, lies a certain distance from the center of the circle, the distance being the radius plus a distance d. A corresponding point on the bed knife lies in the same plane extending at a right angle to the axis of the cylinder at a distance also equal to the radius plus the same distance d. This means that, as the cutter rotates, there is always a point on each side of the knife edge 119 that lies on the same position in space as a point on the edge of the bed knife.

Figure 41:
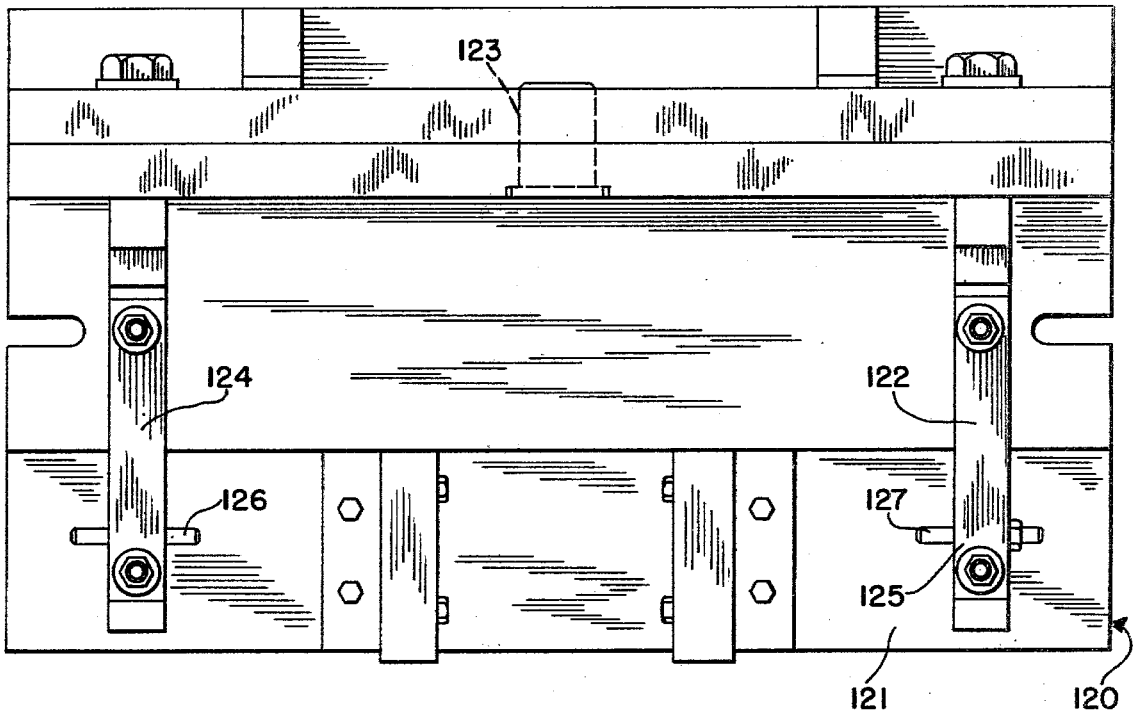
FIG. 41 is a plan view of apparatus for use in forming the rotor of the granulator.
Figure 42:
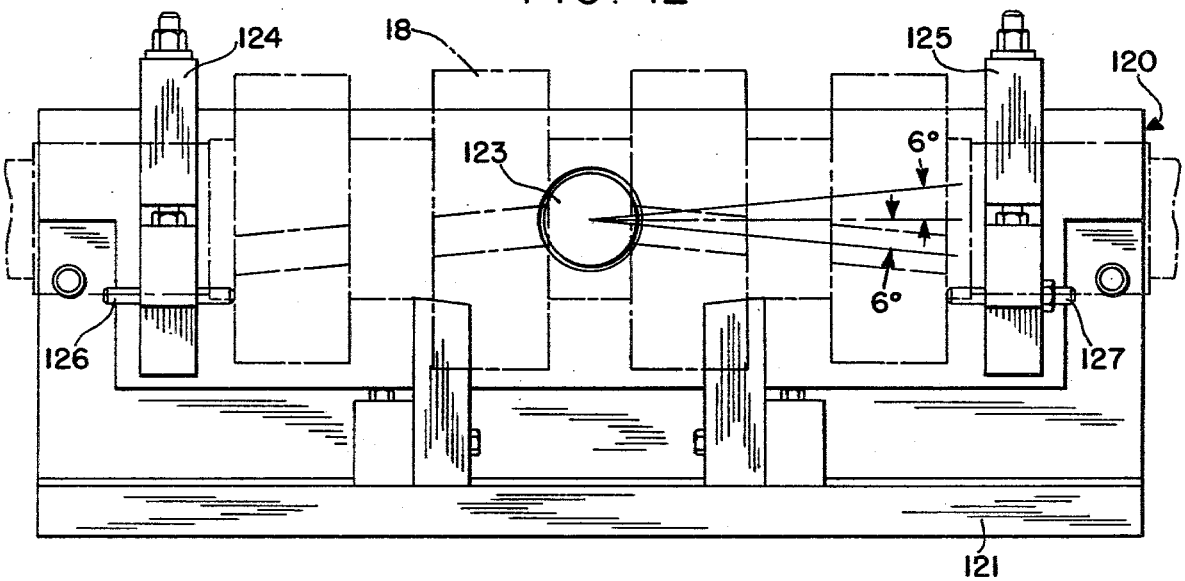
FIG. 42 is a frong elevational view of the apparatus.
Figure 43:
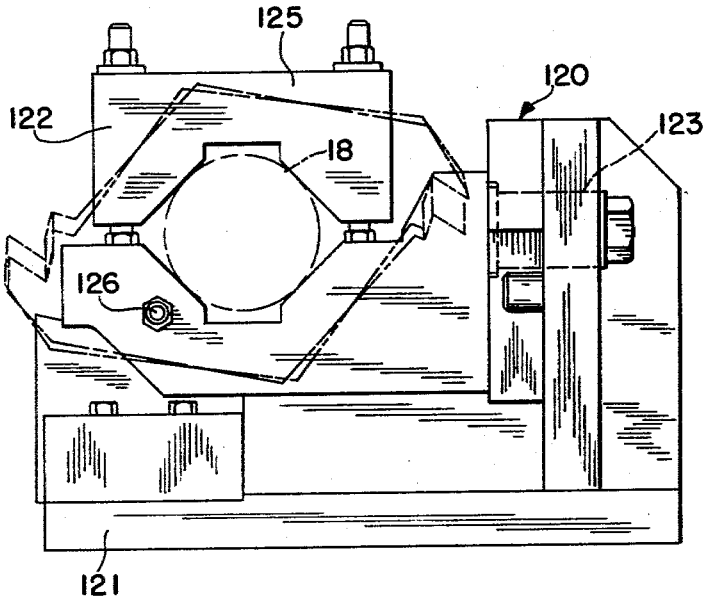
FIG. 43 is an end elevational view of the apparatus.
Figure 44:
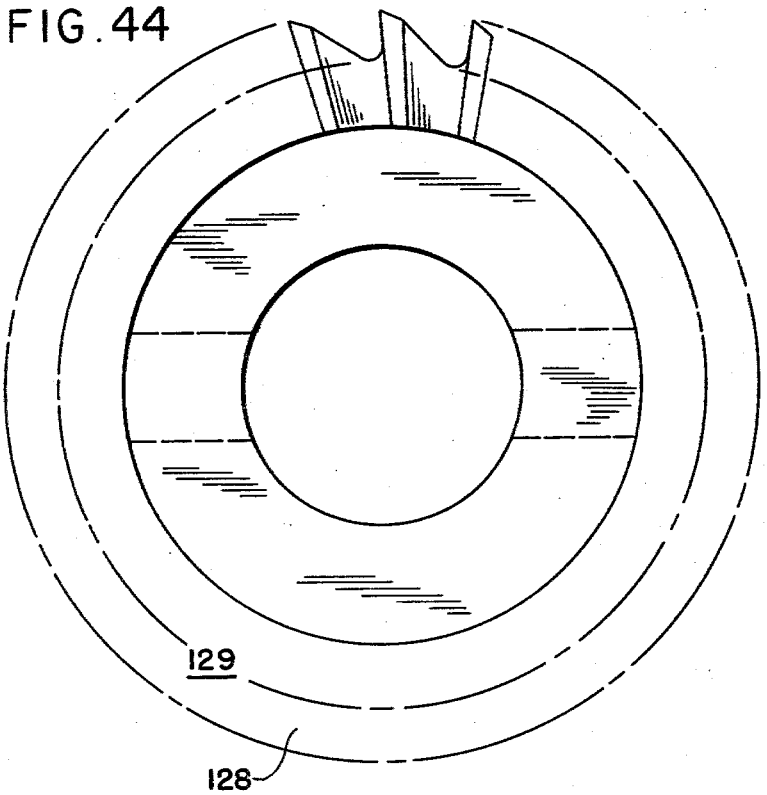
FIG. 44 is a front elevational view of a milling cutter used in forming the rotor.
Figure 45:
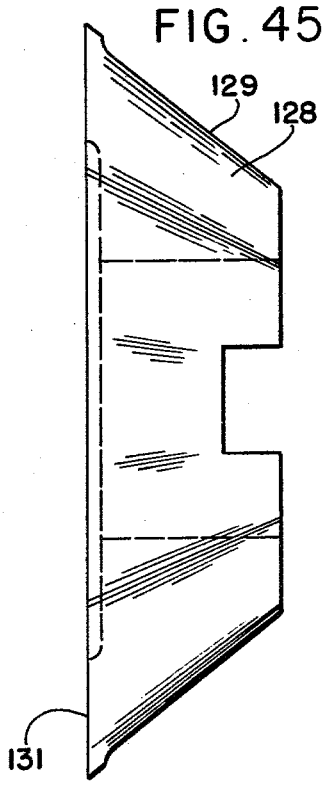
FIG. 45 is a side elevational view of the cutter.

Referring to FIGS. 41, 42, and 43, an apparatus 120 is shown for forming the angular recesses or grooves to hold the knives, the grooves being defined by the surfaces 116 and 117 (FIG. 36) in the rotary cutter 18. The apparatus is provided with a base 121 adapted to be mounted on the horizontal flat upper surface of the table of a milling machine (not shown). A support 122 is mounted on the base 121 for adjustment in a rocking mode about the horizontal axis of a stub shaft 123. The axis of the shaft 123 is also parallel to and spaced from the bottom surface of the base 121 and, therefore, the upper surface of the table of the milling machine. The support 122 includes clamps 124 and 125 for fastening the rotor 18 to the support with the axis of the shaft 123 passing through the axis of the rotor 18. For this purpose, the clamps are provided with opposed V-shaped surfaces for engaging the cylindrical surface of the shaft of the rotor for the accurate location of the rotor axis. Accurately-located stops 126 and 127 serve to locate the rotor 18 in a preselected position of rotation about its axis. As is best shown in FIG. 36, the groove is defined by two plane surfaces 116 and 117 lying at an acute angle to one another and adapted to receive a knife that has a cross-section of parallelogram shape, the knife being reversible, as shown in FIGS. 34 and 35. The groove is formed by use of the milling cutter 128 shown in FIGS. 44 and 45. The cutter has a frusto-conical shape and the plane surface 116 is by the side surface 129 of the cutter, while the surface 117 is formed by the base 131 of the cutter. The stops 126 and 127 are located in such a way that the plane 117 (formed by the base of the cutter 128) lies in a plane perpendicular to the surface of the milling table and the under surface of the base 121. When the knife 109 is mounted in the groove, its cutting edge 119 lies in a plane that is substantially perpendicular to a plane passing through the axis of the rotor.

Figure 46:
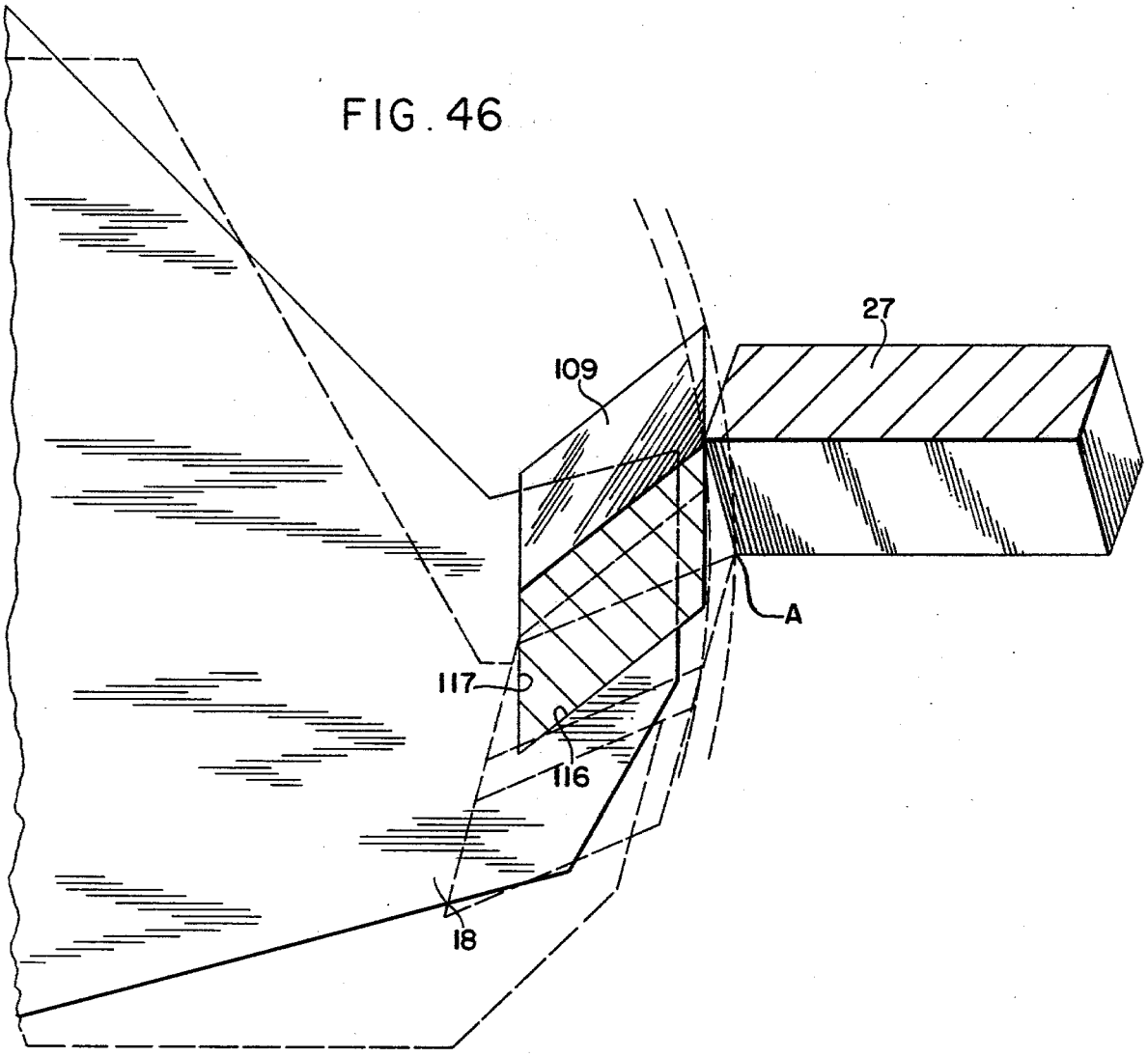
FIG. 46 is a schematic view illustrating the method of forming the rotor.

The method of making the rotor 18 is shown in FIG. 46. The rotor is mounted on the table of the milling machine with the axis of the rotor extending at a small angle (5°) to the plane of the surface of the table, this position being shown in solid lines. At that time the rotor is arranged so that the surface 117 of the groove is in a vertical position and can be finished by the base of the cutter 128 when the cutter is mounted on the horizontal spindle of a milling machine and the table (carrying the rotor) moves past the cutter at the usual feed speed. When the knife 109 is inserted in the groove and the rotor rotated back slightly more than 6°, the knife occupies the position shown in dotted lines, wherein its vertex lies on a horizontal plane passing through the axis of the rotor. At that point it also is in point contact (at the point A) with the bed knife 27. From the geometry it can be seen, then, that in order that the edge of the knife 109 engage smoothly along the edge of the bed knife 27, it is necessary that the ends of the halves of the bed knife be moved inwardly in a horizontal plane a slight amount. This slight angle in the bed knives 27 and 28 can be observed in FIG. 4.

It is obvious that minor changes may be made in the form and construction of the invention without departing from the material spirit thereof. It is now, however, desired to confine the invention to the exact form herein shown and described, but it is desired to include all such as properly come within the scope claimed.

The invention having been thus described, what is claimed as new and desired to secure by Letters Patent is:

1. Granulator, comprising:

(a) a lower housing having an interior space, (b) an upper housing including a hopper mounted on the lower housing, (c) a rotary cutter mounted within said interior space for rotation about a central longitudinal axis and having a V-shaped cutting edge with an apex midway between the ends of the cutter, (d) drive means for rotating the rotary cutter about said axis, and (e) a stationary bed knife located within said interior space and having a V-shaped cutting edge spaced from said axis with an apex midway between the ends of the knife for progressive cutting action with the cutting edge of the rotary cutter, simultaneously on both sides of said apices.

2. Granulator as recited in claim 1, wherein the rotary cutter consists of a spindle whose ends are carried in bearings, a plurality of mounting blocks mounted along the spindle, and two V-shaped blades carried in the mounting blocks and positioned diametrically of the spindle.

3. Granulator as recited in claim 2, wherein each blade is formed with spaced, parallel main surfaces and edge surfaces extending angularly therefrom, so that the cross-sectional shape is that of a parallelogram.

4. Granulator as recited in claim 3, wherein two bed knives are mounted in the housing on opposite sides of the spindle axis, and each bed knife is formed similarly to one of the said blades, each cutter blade mounted with V-shaped edges having its apex facing outwards of the spindle axis and each knife mounted with an interior V-shaped edge facing toward the spindle with its apex away from the spindle axis.

5. Granulator as recited in claim 1, wherein removable sound-absorbing panels are mounted on the surfaces of the lower housing.

6. Granulator as recited in claim 1, wherein the upper housing is mounted on the lower housing for sliding movement from an operative position overlying the blade and knife to an inoperative position in which the cutter and knife are exposed.

7. Granulator as recited in claim 6, wherein the lower housing is provided with a track along each side, the upper housing having wheels which roll along the track to permit it to move readily from the operative position to the inoperative, the wheels being mounted on springs, and clamps associated with each rail to pull the upper housing downwardly against the spring pressure and lock it in a selected position relative to the lower housing.

8. Granulator as recited in claim 1, wherein the lower housing is of generally rectangular plan form with a caster wheel extending downwardly from each corner, wherein the cutter and the bed knife are located adjacent one end and the drive means is located adjacent the other end, and wherein a transverse passage extends through the lower housing underlying the cutter to receive a receptacle into which granulated material falls.

* * * * *